US012213579B2

(12) United States Patent
Yeates et al.

(10) Patent No.: US 12,213,579 B2
(45) Date of Patent: Feb. 4, 2025

(54) BI-DIRECTIONAL ACCESSORY ATTACHMENT INTERFACE

(71) Applicant: Sentry Solutions Products Group LLC, Virginia Beach, VA (US)

(72) Inventors: Eric M. Yeates, Virginia Beach, VA (US); Frederick W. Storms, Jr., Virginia Beach, VA (US)

(73) Assignee: Sentry Solutions Products Group LLC, Virginia Beach, VA (US)

( * ) Notice: Subject to any disclaimer, the term of this patent is extended or adjusted under 35 U.S.C. 154(b) by 0 days.

(21) Appl. No.: 17/422,324

(22) PCT Filed: Jan. 22, 2020

(86) PCT No.: PCT/US2020/014532
§ 371 (c)(1),
(2) Date: Jul. 12, 2021

(87) PCT Pub. No.: WO2020/154355
PCT Pub. Date: Jul. 30, 2020

(65) Prior Publication Data

US 2022/0095773 A1 Mar. 31, 2022

Related U.S. Application Data

(60) Provisional application No. 62/795,542, filed on Jan. 22, 2019.

(51) Int. Cl.
*A45F 5/02* (2006.01)

(52) U.S. Cl.
CPC ..... *A45F 5/021* (2013.01)

(58) Field of Classification Search
CPC .... A45F 5/02; A45C 2013/306; F41C 33/046; F41C 33/041
(Continued)

(56) References Cited

U.S. PATENT DOCUMENTS 4,759,483 A * 7/1988 Willoughby ..... F41C 33/045 224/672
4,998,653 A * 3/1991 LaBelle ..... A45F 5/00 D3/226
(Continued)

FOREIGN PATENT DOCUMENTS

WO 2018118954 6/2018

*Primary Examiner* — Adam J Waggenspack
(74) *Attorney, Agent, or Firm* — Shaddock Law Group, PC

(57) ABSTRACT

A bi-directional accessory attachment interface having an accessory attachment interface, wherein the accessory attachment interface is attached or coupled, at one or more attachment points/areas to an accessory to define a first vertical tunnel aperture proximate a first edge portion of the accessory attachment interface, a second vertical tunnel aperture proximate a second edge portion of the accessory attachment interface, a first horizontal tunnel aperture proximate a first edge portion of the accessory attachment interface, and a second horizontal tunnel aperture proximate the second edge portion of the accessory attachment interface, wherein a vertical tunnel is formed between the first vertical tunnel aperture and the second vertical tunnel aperture, and wherein a horizontal tunnel is formed between the first horizontal tunnel aperture and the second horizontal tunnel aperture.

20 Claims, 12 Drawing Sheets

(58) Field of Classification Search
USPC ..... 224/581
See application file for complete search history.

(56) References Cited

U.S. PATENT DOCUMENTS

| | | | | |
|---|---|---|---|---|
| 8,231,038 | B2 * | 7/2012 | Felts | A45F 5/021 224/679 |
| 8,608,041 | B1 | 12/2013 | Adkisson | |
| 9,173,436 | B2 * | 11/2015 | Crye | A45F 3/14 |
| 9,445,654 | B2 * | 9/2016 | Drew | A45F 3/005 |
| 9,780,344 | B2 * | 10/2017 | Thiel | A41D 1/002 |
| 10,631,618 | B2 * | 4/2020 | Wasylko | F41C 33/0236 |
| 2010/0025560 | A1 | 2/2010 | Beck | |
| 2017/0127812 | A1 * | 5/2017 | Alcantra | F41C 33/046 |
| 2019/0000221 | A1 * | 1/2019 | Yeates | A45C 3/001 |

* cited by examiner

BI-DIRECTIONAL ACCESSORY ATTACHMENT INTERFACE

CROSS-REFERENCE TO RELATED APPLICATIONS

This patent application claims the benefit of U.S. Patent Application Ser. No. 62/795,542, filed Jan. 22, 2019, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE PRESENT DISCLOSURE

1. Field of the Present Disclosure

The present disclosure relates generally to the field of modular attachment systems. More specifically, the present disclosure relates to a bi-directional accessory attachment interface.

2. Description of Related Art

It is advantageous be able to attach and remove various accessories such as pouches, pockets, holsters, holders, and other accessories to items such as, for example, a belt or other carriers.

It is generally known to include belt loops made of loops of material or parallel apertures through which a belt can be threaded to attach and accessory to a belt.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE PRESENT DISCLOSURE

However, the typical loops or other accessory attachments have various shortcomings. For example, known belt loops or similar accessory attachments are affixed to the accessory to maintain the accessory in a single orientation relative to the belt. For example, belt loops may be attached or coupled to an accessory such that the belt can be positioned or woven through the belt loops to maintain the accessory in a substantially horizontal manner, relative to the belt. Alternatively, belt loops may be attached or coupled to an accessory such that the belt can be positioned or woven through the belt loops to maintain the accessory in a substantially vertical manner, relative to the belt. This results a single option for attaching or coupling an accessory to a belt, either in a substantially horizontal manner or a substantially vertical manner, depending upon the position of the belt loops. This only provides for attachment or coupling a single directional orientation and does not allow use of the option of attaching or coupling the accessory to the belt in either a substantially horizontal or substantially vertical manner.

In order to solve these and other shortcomings of known belt loops or other accessory attachments, the bi-directional accessory attachment interface of the present disclosure provides an accessory attachment interface allows an accessory to optionally be attached to a belt, a portion of webbing, a strap, or other device in a substantially vertical manner relative to the belt or other device (wherein a longitudinal axis, $A_L$, of the accessory is substantially perpendicular to a longitudinal axis, $A_L$, of the belt), a substantially horizontal manner relative to the belt or other device (wherein a longitudinal axis, $A_L$, of the accessory is substantially parallel to a longitudinal axis, $A_L$, of the belt), or other manner relative to the belt or other device (wherein a longitudinal axis, $A_L$, of the accessory is at a desired angle relative to a longitudinal axis, $A_L$, of the belt).

In various exemplary, non-limiting embodiments, the bi-directional accessory attachment interface of the present disclosure provides an accessory attachment interface that attached are coupled to or formed as an integral portion of an accessory and allows the accessory to be attached or coupled to belt or similar device in one of at least two orientations.

In various exemplary, nonlimiting embodiments, the bi-directional accessory attachment interface of the present disclosure provides at least one vertical tunnel and at least one horizontal tunnel, which allow the accessory to be attached coupled to a belt in a substantially vertical manner or a substantially horizontal manner, respectively.

In various exemplary, nonlimiting embodiments, the bi-directional accessory attachment interface of the present disclosure includes at least some of an attachment interface panel, wherein the attachment interface panel is attached or coupled, at one or more attachment points/areas to an accessory to define a first vertical tunnel aperture proximate a first edge portion of the attachment interface panel, a second vertical tunnel aperture proximate a second edge portion of the attachment interface panel, a first horizontal tunnel aperture proximate a first edge portion of the attachment interface panel, and a second horizontal tunnel aperture proximate the second edge portion of the attachment interface panel, wherein a vertical tunnel is formed between the first vertical tunnel aperture and the second vertical tunnel aperture, and wherein a horizontal tunnel is formed between the first horizontal tunnel aperture and the second horizontal tunnel aperture.

In certain exemplary, nonlimiting embodiments, the attachment interface panel is attached or coupled at one or more attachment points/areas, to a portion of a carrier material of the accessory.

In certain exemplary, nonlimiting embodiments, at least a portion of the horizontal tunnel is formed between a rear surface of the attachment interface panel and an outer surface of the accessory.

In certain exemplary, nonlimiting embodiments, at least a portion of the vertical tunnel is formed between a rear surface of the attachment interface panel and an outer surface of the accessory.

In certain exemplary, nonlimiting embodiments, a longitudinal axis of the horizontal tunnel and a longitudinal axis of the vertical tunnel are offset by approximately 90°.

In certain exemplary, nonlimiting embodiments, a longitudinal axis of the horizontal tunnel and a longitudinal axis of the vertical tunnel are offset by an obtuse angle.

In certain exemplary, nonlimiting embodiments, a longitudinal axis of the horizontal tunnel and a longitudinal axis of the vertical tunnel are offset by an acute angle.

In certain exemplary, nonlimiting embodiments, the first vertical tunnel aperture is separated from the second vertical tunnel aperture by a distance that is equal to or less than a length of the attachment interface panel.

In certain exemplary, nonlimiting embodiments, the first vertical tunnel aperture and the second vertical tunnel aperture are formed through a portion of the attachment interface panel.

In certain exemplary, nonlimiting embodiments, the first horizontal tunnel aperture and the second horizontal tunnel aperture are formed through portion of the attachment interface panel.

In certain exemplary, nonlimiting embodiments, one or more alternate attachment elements are formed in or through the attachment interface panel.

In certain exemplary, nonlimiting embodiments, one or more alternate attachment elements comprise a plurality of spaced apart matrix apertures, wherein the matrix apertures are arranged in a series or sequence of equally spaced rows and equally spaced columns.

In various exemplary, nonlimiting embodiments, the bi-directional accessory attachment interface of the present disclosure includes at least some of an attachment interface panel having a first vertical tunnel aperture formed proximate a first edge portion of the attachment interface panel, a second vertical tunnel aperture formed proximate a second edge portion of the attachment interface panel, a first horizontal tunnel aperture formed proximate a first edge portion of the attachment interface panel, and a second horizontal tunnel aperture formed proximate the second edge portion of the attachment interface panel, wherein a vertical tunnel is formed between the first vertical tunnel aperture and the second vertical tunnel aperture, and wherein a horizontal tunnel is formed between the first horizontal tunnel aperture and the second horizontal tunnel aperture.

In certain exemplary, nonlimiting embodiments, the first vertical tunnel aperture, the second vertical tunnel aperture, the first horizontal tunnel aperture, and the second horizontal tunnel aperture comprise holes or aperture formed through a portion of the accessory.

In certain exemplary, nonlimiting embodiments, one or more alternate attachment elements are formed in or through the attachment interface panel.

In certain exemplary, nonlimiting embodiments, the one or more alternate attachment elements comprise a plurality of spaced apart matrix apertures, wherein the matrix apertures are arranged in a series or sequence of equally spaced rows and equally spaced columns.

In various exemplary, nonlimiting embodiments, the bi-directional accessory attachment interface of the present disclosure includes at least some of an attachment interface panel, wherein the attachment interface panel is attached or coupled to an accessory at one or more attachment points/areas, wherein a first vertical tunnel aperture is defined proximate a first edge portion of the attachment interface panel between at least two of said at least one or more attachment points/areas, wherein a second vertical tunnel aperture is defined proximate a second edge portion of the attachment interface panel between at least two of said at least one or more attachment points/areas, wherein a first horizontal tunnel aperture is defined proximate a first edge portion of the attachment interface panel between at least two of said at least one or more attachment points/areas, and wherein a second horizontal tunnel aperture is defined proximate the second edge portion of the attachment interface panel between at least two of said at least one or more attachment points/areas, wherein a vertical tunnel is formed between the first vertical tunnel aperture and the second vertical tunnel aperture, wherein a horizontal tunnel is formed between the first horizontal tunnel aperture and the second horizontal tunnel aperture, and wherein one or more alternate attachment elements are formed in or through the attachment interface panel.

In certain exemplary, nonlimiting embodiments, the one or more alternate attachment elements comprise a plurality of spaced apart matrix apertures, wherein the matrix apertures are arranged in a series or sequence of equally spaced rows and equally spaced columns.

In certain exemplary, nonlimiting embodiments, at least a portion of the horizontal tunnel is formed between a rear surface of the attachment interface panel and an outer surface of the accessory.

In certain exemplary, nonlimiting embodiments, at least a portion of the vertical tunnel is formed between a rear surface of the attachment interface panel and an outer surface of the accessory.

Accordingly, the present disclosure separately and optionally provide a bi-directional accessory attachment interface that allows a user to readily attach accessory to the accessory attachment interface in at least one of two (i.e., in a vertical or horizontal) orientations.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the present disclosure that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the present disclosure will be described in detail, with reference to the following figures, wherein like reference numerals refer to like parts throughout the several views, and wherein.

DETAILED DESCRIPTION OF EXEMPLARY EMBODIMENTS OF THE PRESENT DISCLOSURE

Figure 1:
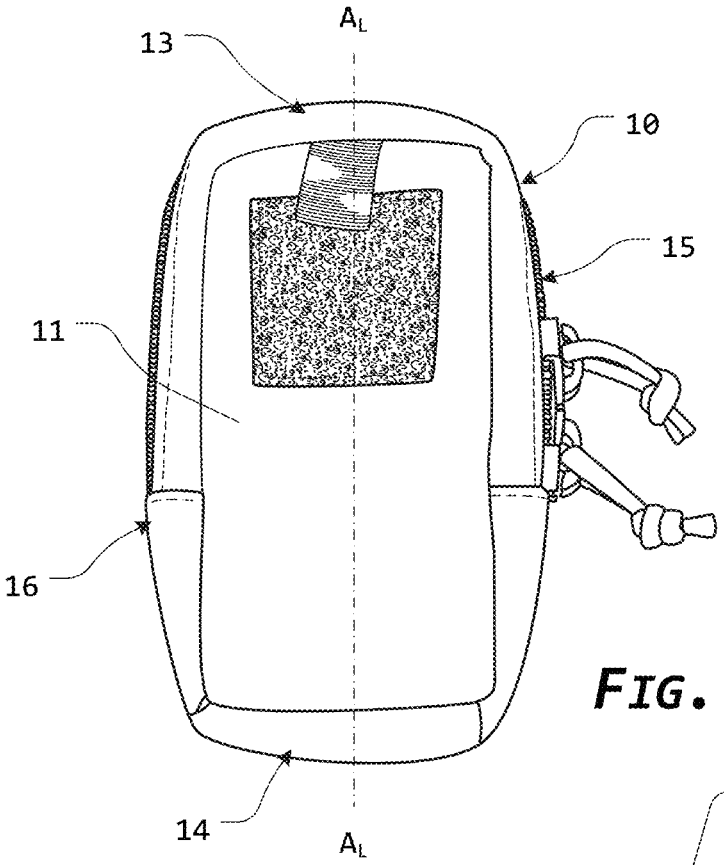
FIG. 1 illustrates a front view of an exemplary embodiment of an accessory, according to the present disclosure.
Figure 2:
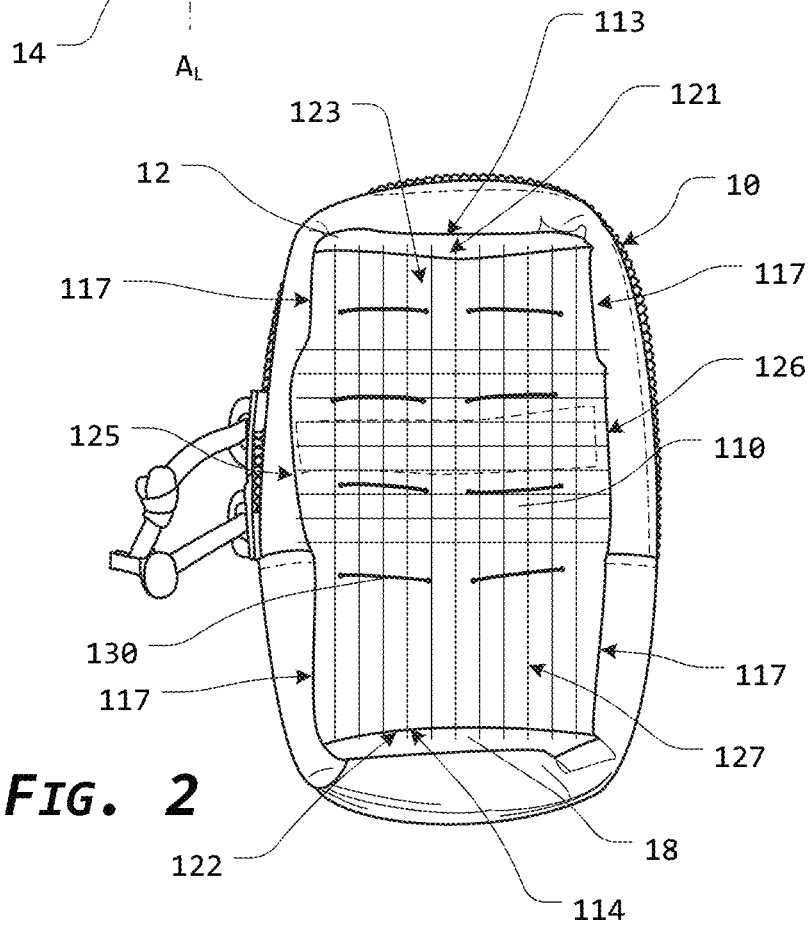
FIG. 2 illustrates a rear view of an accessory having a bi-directional accessory attachment interface according to an exemplary embodiment of the present disclosure.
Figure 3:
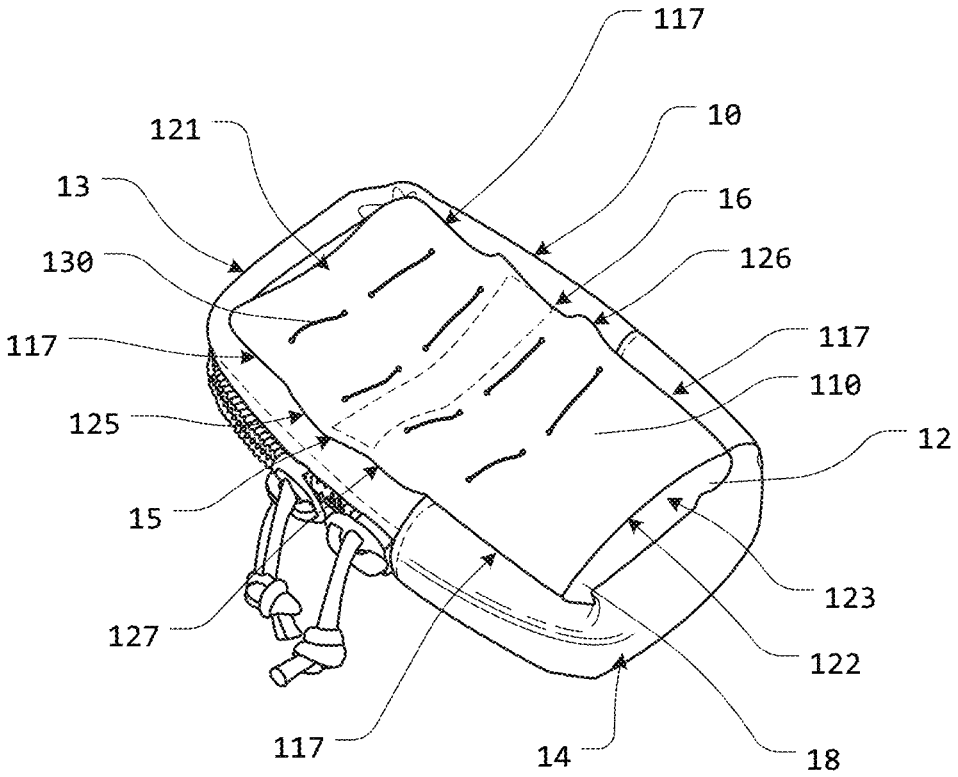
FIG. 3 illustrates a rear perspective view of an accessory having a bi-directional accessory attachment interface according to an exemplary embodiment of the present disclosure.
Figure 4:
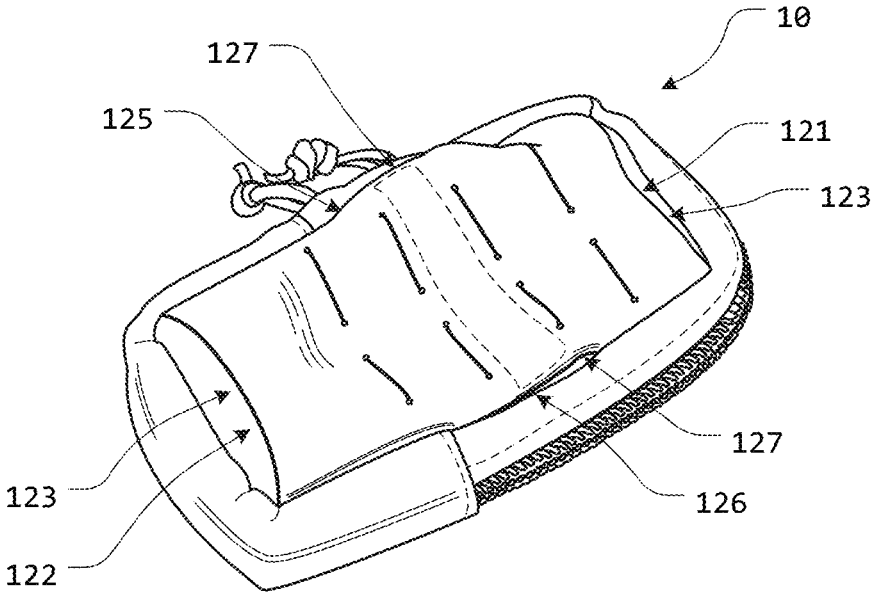
FIG. 4 illustrates a rear perspective view of an accessory having a bi-directional accessory attachment interface according to an exemplary embodiment of the present disclosure.
Figure 5:
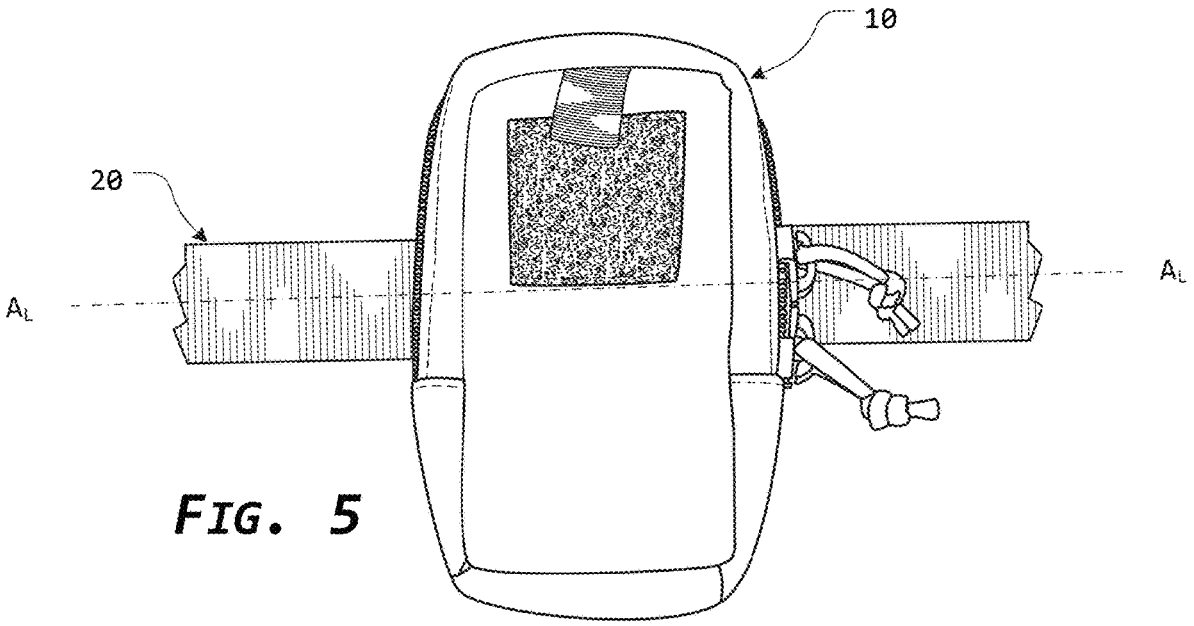
FIG. 5 illustrates a front view of an accessory having a bi-directional accessory attachment interface, attached to an exemplary belt in a substantially vertical orientation, according to an exemplary embodiment of the present disclosure.
Figure 6:
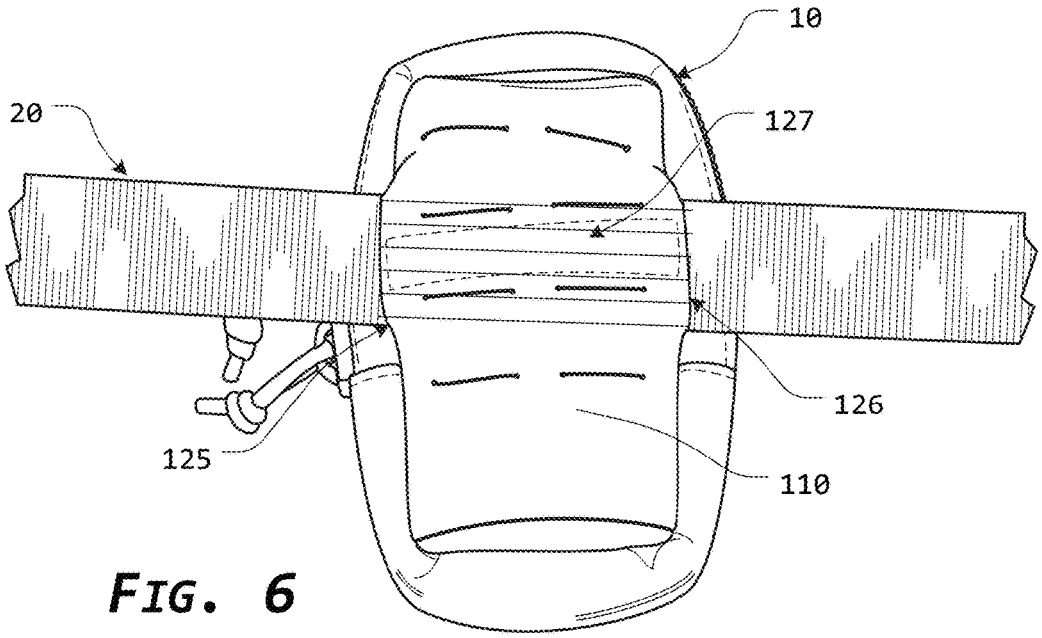
FIG. 6 illustrates a rear view of an accessory having a bi-directional accessory attachment interface, attached to an exemplary belt in a substantially vertical orientation, according to an exemplary embodiment of the present disclosure.
Figure 7:
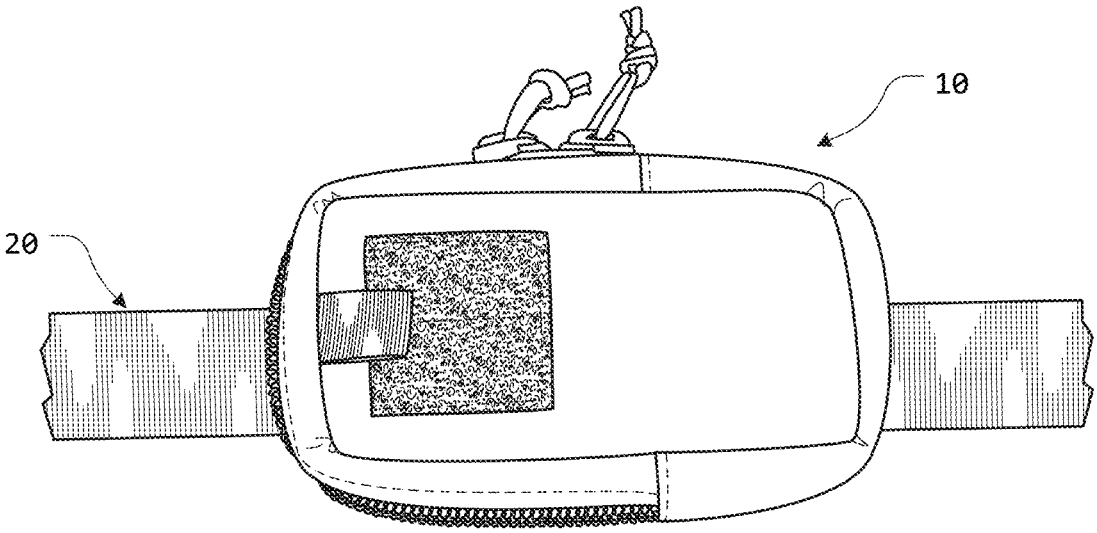
FIG. 7 illustrates a front view of an accessory having a bi-directional accessory attachment interface, attached to an exemplary belt in a substantially horizontal orientation, according to an exemplary embodiment of the present disclosure.
Figure 8:
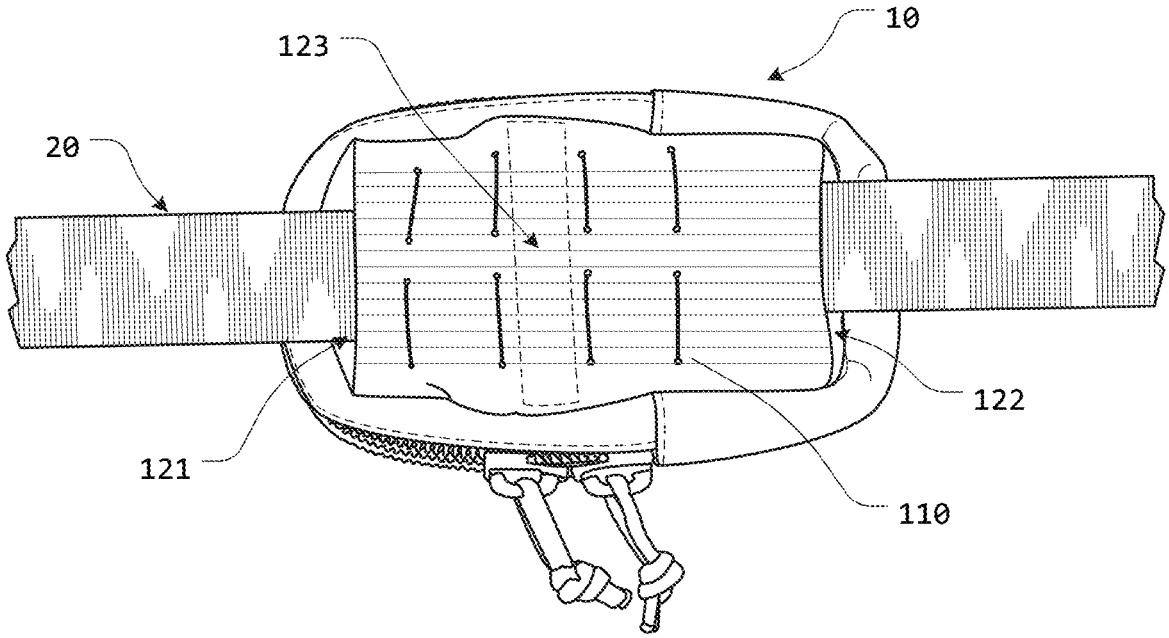
FIG. 8 illustrates a rear view of an accessory having a bi-directional accessory attachment interface, attached to an exemplary belt in a substantially horizontal orientation, according to an exemplary embodiment of the present disclosure.
Figure 9:
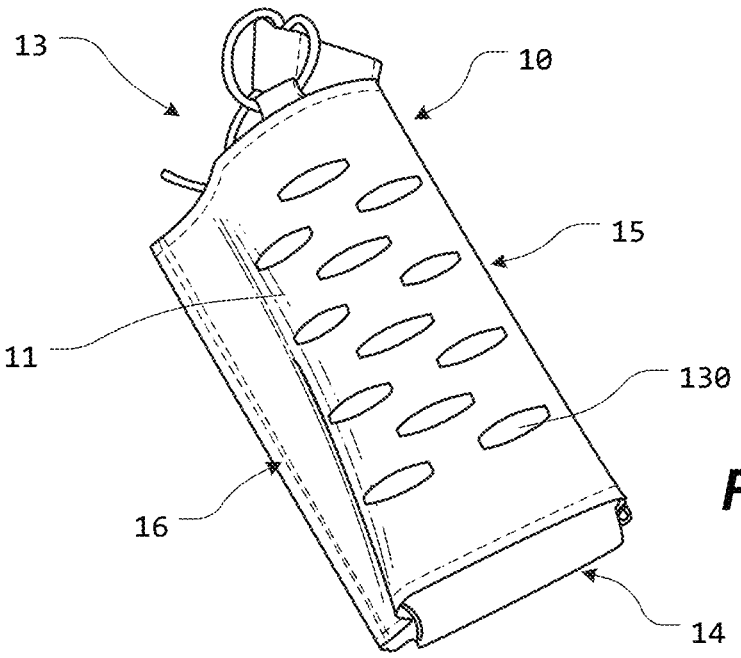
FIG. 9 illustrates a front perspective view of an exemplary embodiment of an accessory, according to the present disclosure.
Figure 10:
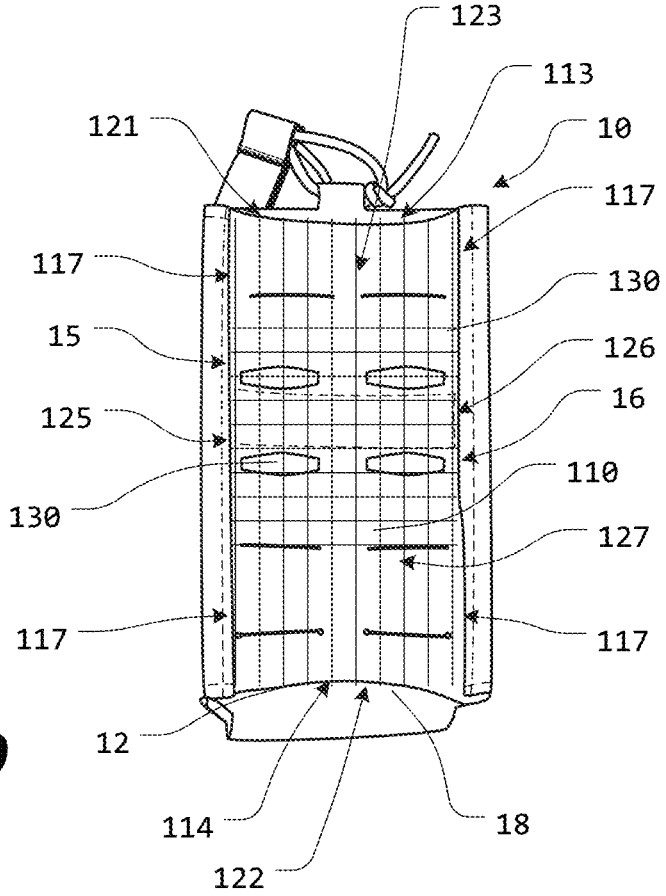
FIG. 10 illustrates a rear view of an accessory having a bi-directional accessory attachment interface according to an exemplary embodiment of the present disclosure.
Figure 11:
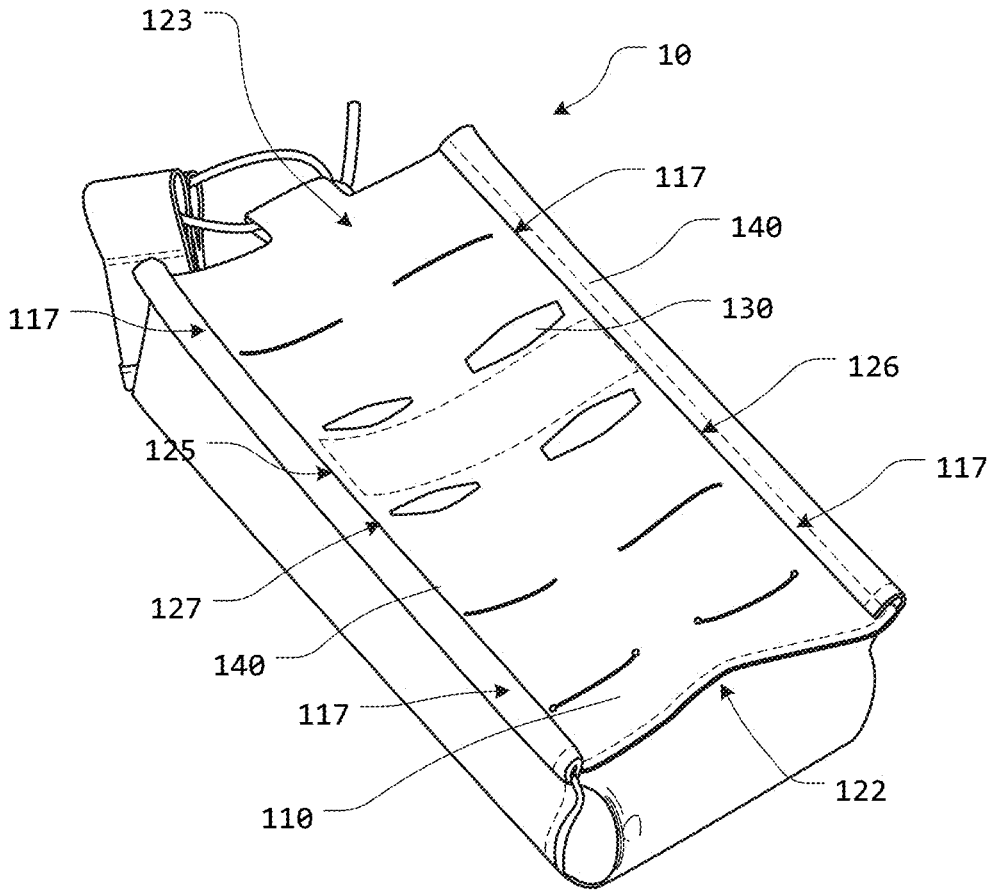
FIG. 11 illustrates a rear perspective view of an accessory having a bi-directional accessory attachment interface according to an exemplary embodiment of the present disclosure.
Figure 12:
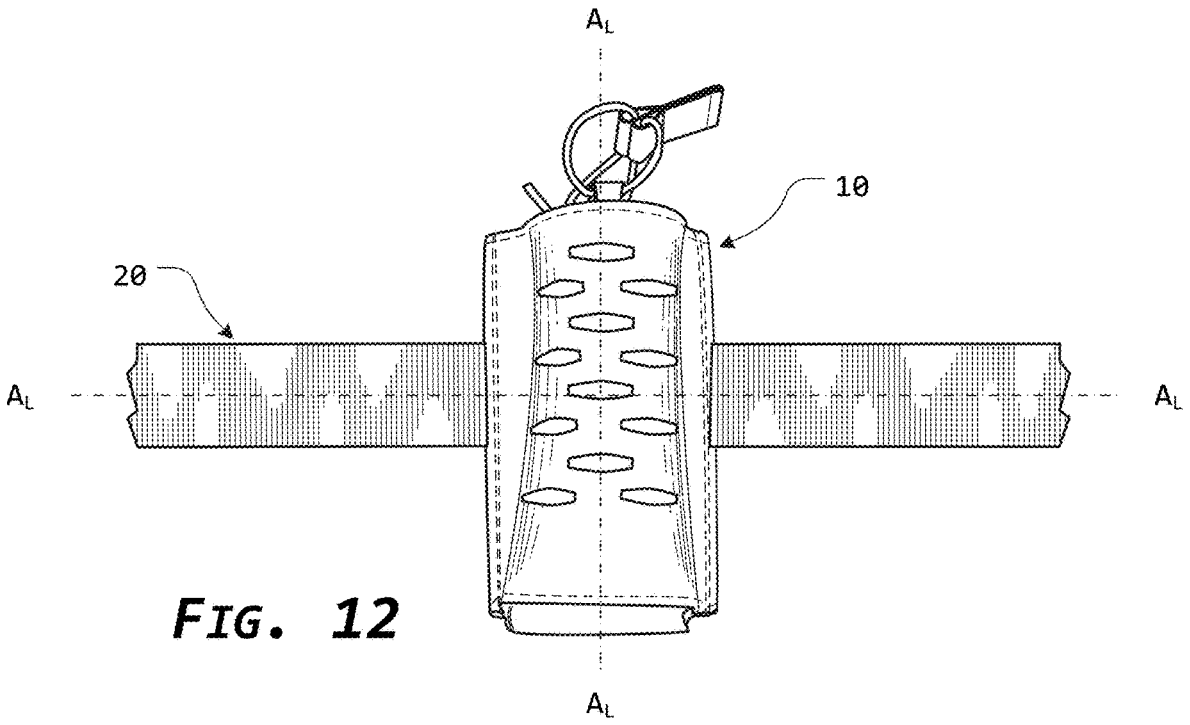
FIG. 12 illustrates a front view of an accessory having a bi-directional accessory attachment interface, attached to an exemplary belt in a substantially vertical orientation, according to an exemplary embodiment of the present disclosure.
Figure 13:
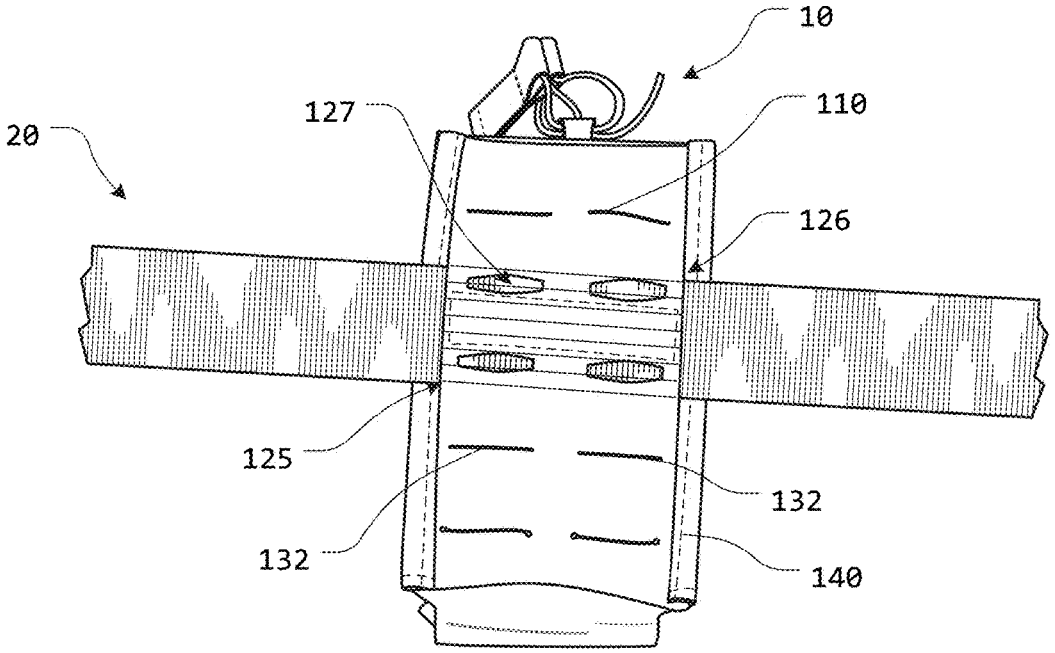
FIG. 13 illustrates a rear view of an accessory having a bi-directional accessory attachment interface, attached to an exemplary belt in a substantially vertical orientation, according to an exemplary embodiment of the present disclosure.
Figure 14:
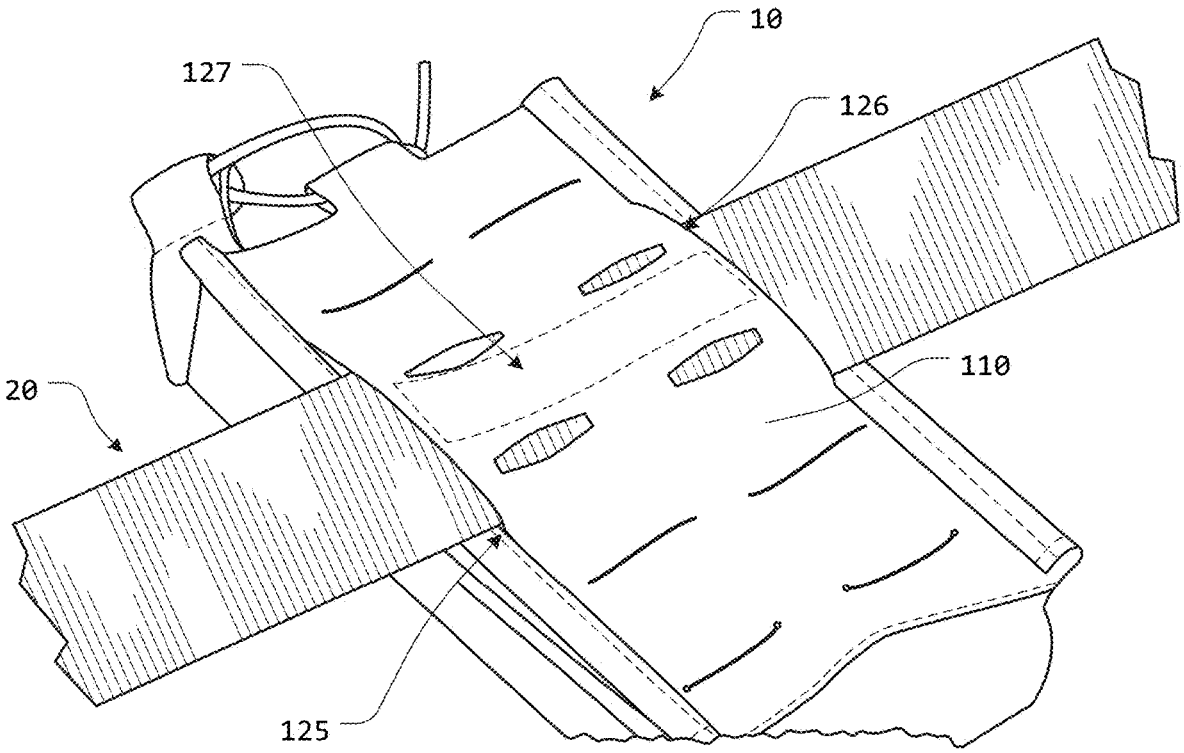
FIG. 14 illustrates a rear perspective view of an accessory having a bi-directional accessory attachment interface, attached to an exemplary belt in a substantially vertical orientation, according to an exemplary embodiment of the present disclosure.
Figure 15:
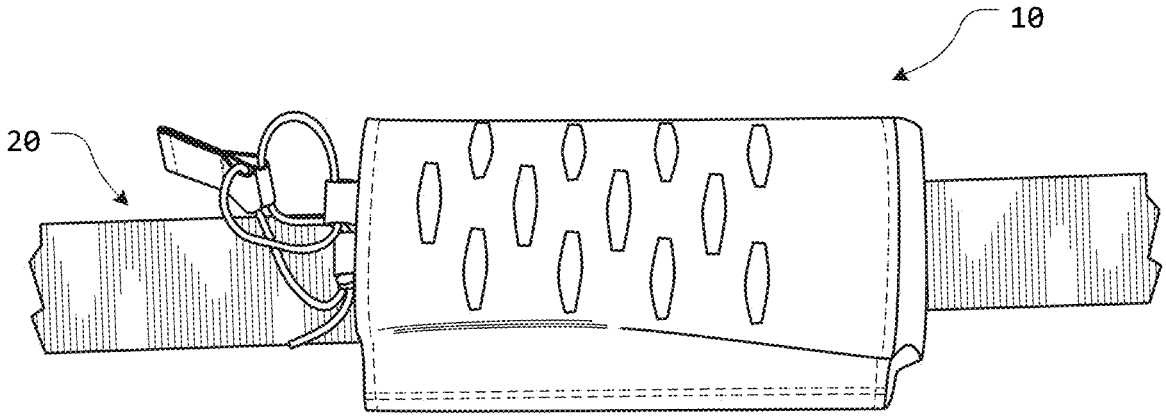
FIG. 15 illustrates a front view of an accessory having a bi-directional accessory attachment interface, attached to an exemplary belt in a substantially horizontal orientation, according to an exemplary embodiment of the present disclosure.
Figure 16:
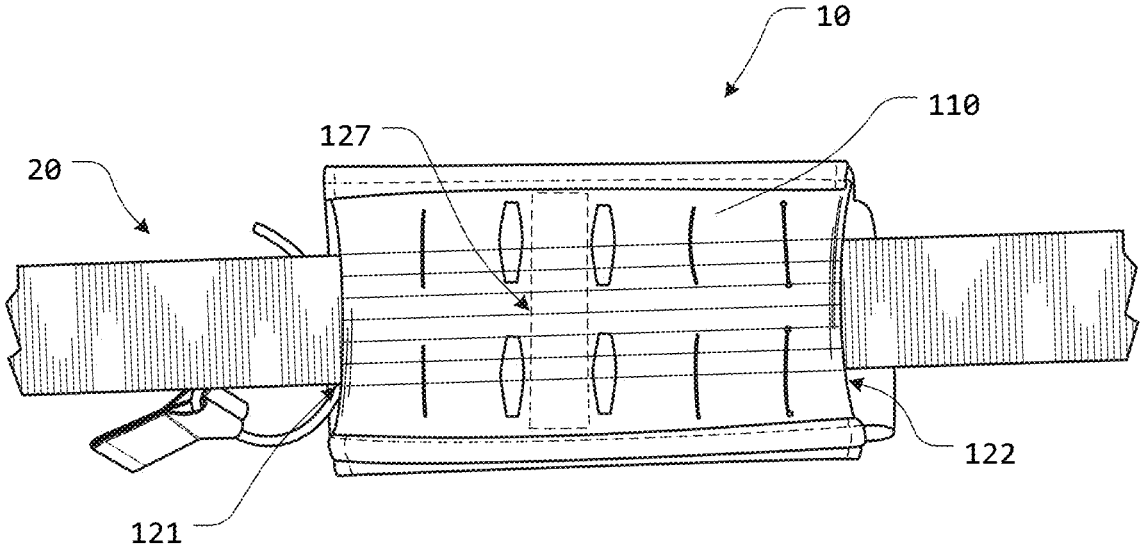
FIG. 16 illustrates a rear view of an accessory having a bi-directional accessory attachment interface, attached to an exemplary belt in a substantially horizontal orientation, according to an exemplary embodiment of the present disclosure.

The foregoing and other objectives, features, and advantages of the invention will be more readily understood upon consideration of the following description of the invention taken in conjunction with the accompanying drawings.

For simplicity and clarification, the design factors and operating principles of the bi-directional accessory attachment interface according to the present disclosure are explained with reference to various exemplary embodiments of a bi-directional accessory attachment interface according to the present disclosure. The basic explanation of the design factors and operating principles of the bi-directional accessory attachment interface is applicable for the understanding, design, and operation of the bi-directional accessory attachment interface of the present disclosure. It should be appreciated that the bi-directional accessory attachment interface can be adapted to many applications where a bi-directional accessory attachment interface can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

As used herein, the word "may" is meant to convey a permissive sense (i.e., meaning "having the potential to"), rather than a mandatory sense (i.e., meaning "must"). Unless stated otherwise, terms such as "first" and "second", "right" and "left", "front" and "rear", "top" and "bottom", "upper" and "lower", and "horizontal" and "vertical" are used as a naming convention to arbitrarily distinguish between the exemplary embodiments and/or elements such terms describe. Thus, these terms are not necessarily intended to indicate temporal or other prioritization of such exemplary embodiments and/or elements, but are used to help differentiate between certain of the components of the present disclosure and are not to be construed as limiting the present disclosure.

As used herein, and unless the context dictates otherwise, the term "coupled" is intended to include both direct coupling (in which two elements that are coupled to each other contact each other) and indirect coupling (in which at least one additional element is located between the two elements). The term coupled, as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "bi-directional", "accessory attachment interface", "carrier portion", and "accessory" are used for basic explanation and understanding of the operation of the systems, methods, and apparatuses of the present disclosure. Therefore, the terms "bi-directional", "accessory attachment interface", "carrier portion", and "accessory" are not to be construed as limiting the systems, methods, and apparatuses of the present disclosure.

Turning now to the appended drawing figures, FIGS. 1-8 and 9-16 illustrate certain elements and/or aspects of an exemplary embodiment of a bi-directional accessory attachment interface 100, according to the present disclosure.

For simplicity and clarification, the bi-directional accessory attachment interface 100 of the present disclosure will be shown and/or described as being used in conjunction with a rear portion or surface of an exemplary accessory pouch being utilized as an exemplary accessory 10. As illustrated, the accessory 10 comprises an accessory pouch that includes a front side 11 and a rear side 12. The accessory 10 extends from an upper, top end 13 to a lower, bottom end 14 and from a right side 15 to a left side 16. Furthermore, the bi-directional accessory attachment interface 100 of the present disclosure will be shown and/or described as being special coupled to exemplary belt 20. However, it should be appreciated that these are merely exemplary embodiments of the bi-directional accessory attachment interface 100 and are not to be construed as limiting the present disclosure. Thus, the bi-directional accessory attachment interface 100 of the present disclosure may be utilized in conjunction with any object or device.

In certain illustrative, non-limiting embodiment(s) of the present disclosure, as illustrated in FIGS. 1-8 and 9-16, the accessory attachment interface 100 comprises an attachment interface panel 110. The attachment interface panel 110 includes a front side 111 and an opposing a rear side 112. The attachment interface panel 110 extends from a right side 115 to a left side 116 and from an upper end 113 to a lower end 114.

The attachment interface panel 110 is formed so as to overlay at least a portion of the accessory 10 and be attached or coupled, at one or more attachment points/areas 117 to a portion of the accessory 10. As illustrated, the attachment interface panel 110 may optionally be attached or coupled to the rear side of the accessory 10. However, the attachment interface panel 110 may optionally be attached or coupled to the rear side and/or the front side of the accessory 10. Various exemplary embodiments, the attachment points/areas 117 are located proximate four corner portions of the attachment interface panel 110. However, it should be appreciated that the number and placement of the attachment points/areas 117 is a design choice and the attachment points/areas 117 may be formed at any desired location relative to the accessory 10 and the attachment interface panel 110.

In certain exemplary embodiments, the attachment interface panel 110 is attached or coupled to the accessory 10 (or to a carrier portion 18 of the accessory 10) at the attachment points/areas 117 by attachment components 140, such as, for example, stitching. Alternatively, the attachment interface panel 110 is attached or coupled to the accessory 10 (or to a carrier portion 18 of the accessory 10) at the attachment points/areas 117 (either proximate a perimeter or at attachment points/areas 117) via stitching, adhesive bonding, welding, screws, rivets, pins, mating hook and loop portions, snap or releasable fasteners, or other known or later developed means or methods for permanently or releasably attaching or coupling the attachment interface panel 110 to the accessory 10 (or to a carrier portion 18 of the accessory 10).

Once appropriately attached or coupled to the accessory 10, an upper or first vertical tunnel aperture 121 is formed between adjacent upper attachment points/areas 117 and a lower or second vertical tunnel aperture 122 is formed between adjacent lower attachment points/areas 117. A vertical tunnel 123 is formed between the upper or first vertical tunnel aperture 121 and the lower or second vertical tunnel aperture 122. In certain exemplary embodiments, at least a portion of the vertical tunnel 123 is formed between a rear surface of the attachment interface panel 110 and an outer surface of the accessory 10 (or the carrier portion 18).

Similarly, a right or first horizontal tunnel aperture 125 is formed between adjacent upper and lower attachment points/areas 117 proximate a right or first edge portion of the attachment interface panel 110 and a left or second horizontal tunnel aperture 126 is formed between adjacent upper and lower attachment points/areas 117 proximate a left or second edge portion of the attachment interface panel 110. A horizontal tunnel 127 is formed between the right or first horizontal tunnel aperture 125 and the left or second horizontal tunnel aperture 126. Certain exemplary embodiments, at least a portion of the horizontal tunnel 127 is formed between a rear surface of the attachment interface panel 110 and an outer surface of the accessory 10 (or the carrier portion 18).

Thus, the attachment interface panel 110 overlays at least a portion of the accessory 10 and is attached or coupled to the accessory 10 (or the carrier portion 18) to define an upper or first vertical tunnel aperture 121 proximate an upper or first edge portion of the attachment interface panel 110, a lower or second vertical tunnel aperture 122 proximate a lower or second edge portion of the attachment interface panel 110, a right or first horizontal tunnel aperture 125 proximate a right or first edge portion of the attachment interface panel 110, and a left or second horizontal tunnel aperture 126 proximate the left or second edge portion of the attachment interface panel 110, wherein a vertical tunnel 123 is formed between the upper or first vertical tunnel aperture 121 and the lower or second vertical tunnel aperture 122, and wherein a horizontal tunnel 127 is formed between the right or first horizontal tunnel aperture 125 and the left or second horizontal tunnel aperture 126.

In certain exemplary, nonlimiting embodiments, a longitudinal axis of the horizontal tunnel 127 and a longitudinal axis of the vertical tunnel 123 are offset by approximately 90°. Alternatively, a longitudinal axis of the horizontal tunnel 127 and a longitudinal axis of the vertical tunnel 123 are offset by an obtuse or an acute angle.

The attachment interface panel 110 is generally attached or coupled to the accessory 10 (or the carrier portion 18) such that a longitudinal axis of the horizontal tunnel 127 is perpendicular to a longitudinal axis of the accessory 10 and a longitudinal axis of the vertical tunnel 123 it is parallel to a longitudinal axis of the accessory 10. However, it should be appreciated that this orientation is merely exemplary and not limiting. Thus, the attachment interface panel 110 may be attached or coupled to the accessory 10 (or the carrier portion 18) such that the longitudinal axis of the horizontal tunnel 127 is positioned at any desired angular orientation relative to the accessory 10 and the longitudinal axis of the vertical tunnel 123 is positioned at any desired angular orientation relative to the accessory 10.

In certain exemplary, nonlimiting embodiments, the upper or first vertical tunnel aperture 121 is separated from the lower or second vertical tunnel aperture 122 by a distance that is equal to or less than a length of the attachment interface panel 110. Thus, the upper or first vertical tunnel aperture 121 is formed at or by an upper edge of the attachment interface panel 110 and the lower or second vertical tunnel aperture 122 is formed at or by a lower edge of the attachment interface panel 110. Alternatively, the upper or first vertical tunnel aperture 121 and the lower or second vertical tunnel aperture 122 may optionally be formed through a portion of the attachment interface panel 110 and not formed at an upper edge or lower edge of the attachment interface panel 110, respectively.

Figure 17:
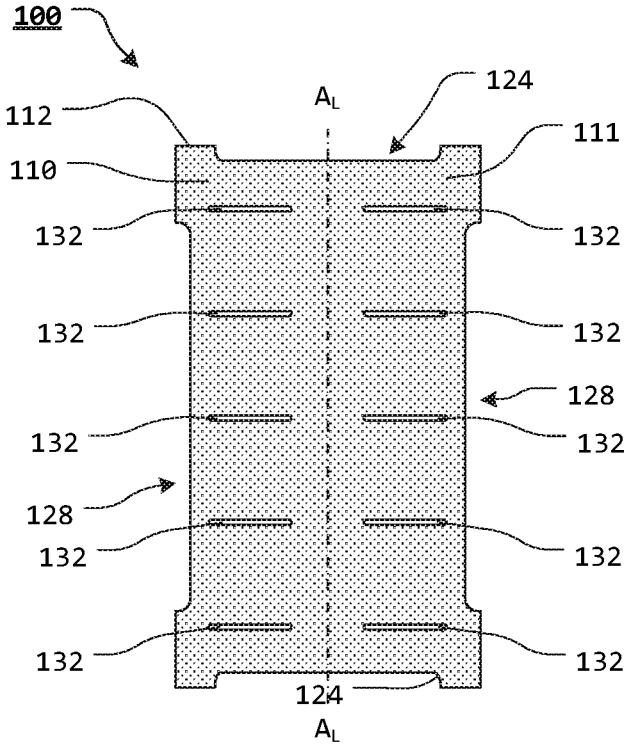
FIG. 17 illustrates a front view of a bi-directional accessory attachment interface, according to an exemplary embodiment of the present disclosure.

As illustrated in FIG. 17, recesses or notches may optionally be formed in portions of the attachment interface panel 110 to be utilized to create the upper or first vertical tunnel aperture 121, the lower or second vertical tunnel aperture 122, the right or first horizontal tunnel aperture 125, and the left or second horizontal tunnel aperture 126. As illustrated, a vertical tunnel notch 124 is formed so as to create the upper or first vertical tunnel aperture 121 and the lower or second vertical tunnel aperture 122, while a horizontal tunnel notch 128 is used to create the right or first horizontal tunnel aperture 125 and the left or second horizontal tunnel aperture 126.

Figure 18:
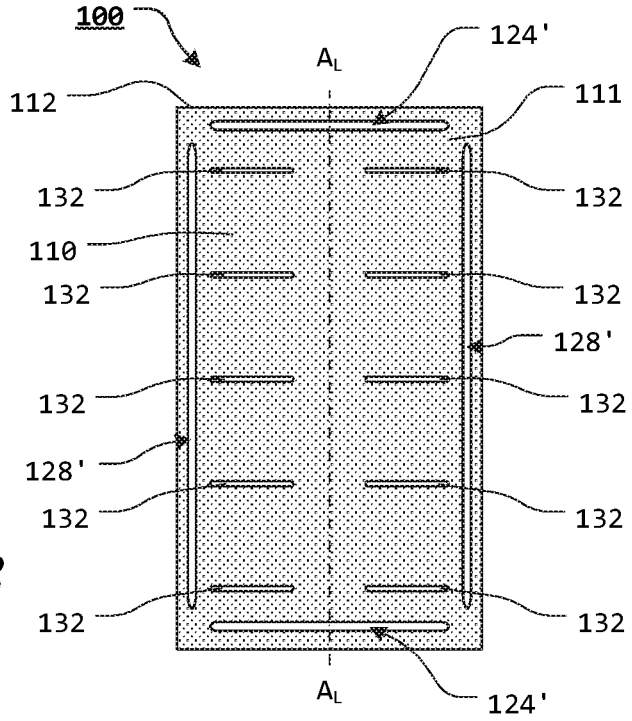
FIG. 18 illustrates a front view of a bi-directional accessory attachment interface, according to an exemplary embodiment of the present disclosure.
Figure 19:
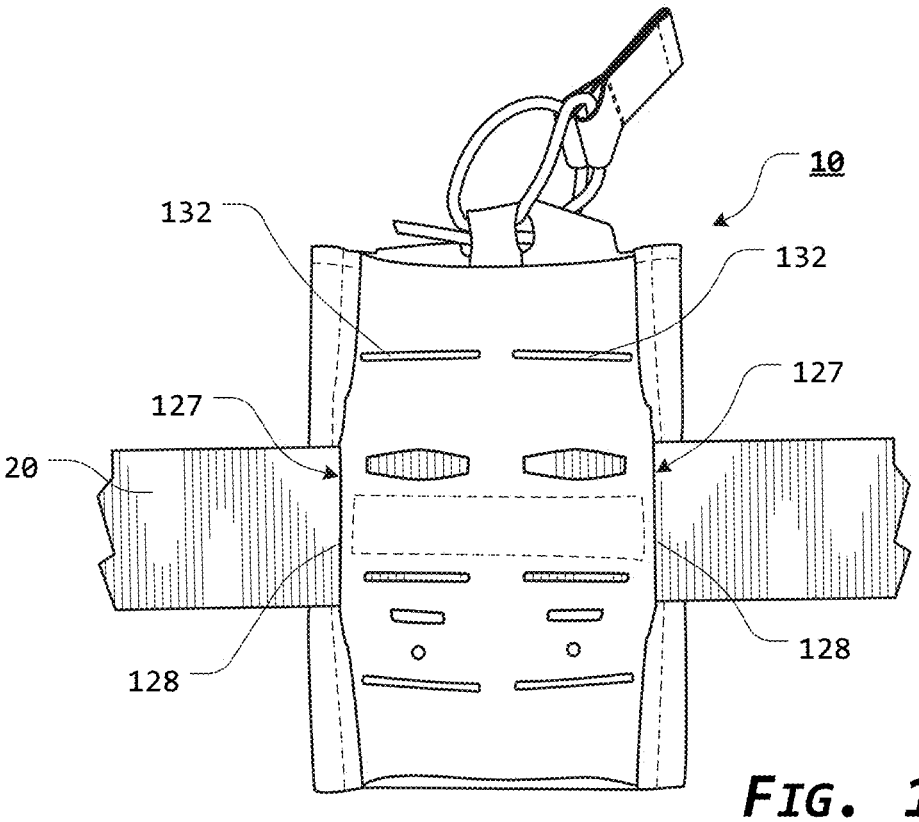
FIG. 19 illustrates a rear perspective view of an accessory having a bi-directional accessory attachment interface, attached to an exemplary belt in a substantially vertical orientation, according to an exemplary embodiment of the present disclosure.
Figure 20:
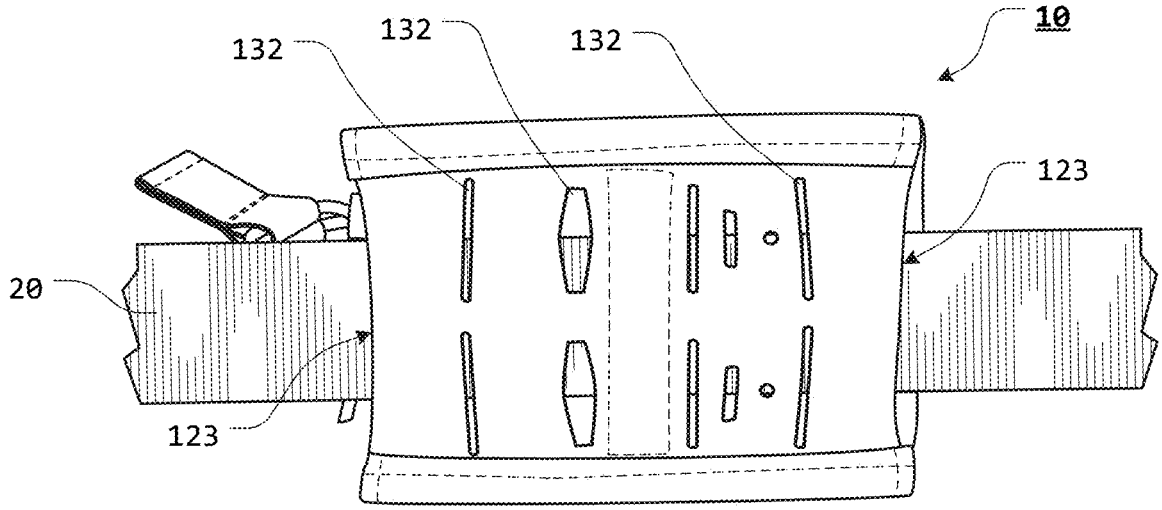
FIG. 20 illustrates a rear view of an accessory having a bi-directional accessory attachment interface, attached to an exemplary belt in a substantially horizontal orientation, according to an exemplary embodiment of the present disclosure.

Alternatively, as illustrated in FIG. 18, elongate apertures or slots may optionally be formed in portions of the attachment interface panel 110 to be utilized to create the upper or first vertical tunnel aperture 121, the lower or second vertical tunnel aperture 122, the right or first horizontal tunnel aperture 125, and the left or second horizontal tunnel aperture 126. As illustrated, a vertical tunnel aperture 124' is formed so as to create the upper or first vertical tunnel aperture 121 and the lower or second vertical tunnel aperture 122, while a horizontal tunnel aperture 128' is used to create the right or first horizontal tunnel aperture 125 and the left or second horizontal tunnel aperture 126.

In certain exemplary embodiments, the attachment interface panel 110 is formed of a portion of a fabric-type or other material, such as, for example, chlorosulfonated polyethylene (CSPE) synthetic rubber (CSM). In certain exemplary embodiments, the attachment interface panel 110 is formed of a portion of Hypalon fabric. However, the present disclosure is not so limited. For example, in certain exemplary embodiments, the attachment interface panel 110 may be formed of a rigid material, a semi-rigid material, or a substantially flexible material.

In various exemplary, non-limiting embodiments, all or portions of the attachment interface panel 110 may be made of any fabric or other material, such as, for example, woven fabrics, canvas, acrylics, sheet fabrics, films, nylon, spandex, vinyl, Polyvinyl Chloride (PVC), neoprene, or the like. Alternatively, all or portions of the attachment interface panel 110 may be formed from multiple, similar or dissimilar materials.

As a further example, in certain exemplary embodiments, the attachment interface panel 110 may be formed of a substantially rigid material, such as plastic, having an appropriate, workable thickness. Alternate materials of construction of the attachment interface panel 110 may include one or more of the following: steel, stainless steel, aluminum, titanium, polytetrafluoroethylene, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the attachment interface panel 110 is a design choice based on the desired appearance and functionality of the accessory attachment interface 100.

It should be appreciated that the terms fabric and material are to be given their broadest meanings and that the particular fabric(s) or material(s) used to form the attachment interface panel 110 is a design choice based on the desired appearance and/or functionality of the accessory attachment interface 100. In general, the material used to form the attachment interface panel 110 is selected for its ability to allow an accessory 10 to be attached or coupled thereto.

In certain exemplary embodiments, the accessory attachment interface 100 is formed as an integral portion of the accessory 10. In these exemplary embodiments, the accessory attachment interface 100 comprises a portion (i.e., a panel or other area) of the accessory 10. In these exemplary embodiments, the upper or first vertical tunnel aperture 121, the lower or second vertical tunnel aperture 122, the right or first horizontal tunnel aperture 125, and the left or second horizontal tunnel aperture 126 may comprise holes or aperture formed through a portion of the accessory 10.

During attachment of an exemplary accessory 10 to an exemplary belt 20, the accessory 10 may optionally be attached to the belt 20 in a substantially vertical manner (as illustrated most clearly in FIGS. 5-6, 12-14, and 19) or may optionally be attached to the belt 20 in a substantially horizontal orientation (as illustrated most clearly in FIGS. 7-8, 15-16, and 20). If it is desired to attach the accessory 10 to the belt 20 in a substantially vertical manner, the belt 20 is aligned with a horizontal tunnel aperture (either the left or second horizontal tunnel aperture 126 or the right or first horizontal tunnel aperture 125), urged through the aligned horizontal tunnel aperture, and woven or threaded through the horizontal tunnel 127 until the belt 20 exits the opposite horizontal tunnel aperture (either the right or first horizontal tunnel aperture 125 or the left or second horizontal tunnel aperture 126). If the belt 20 is positioned such that a longitudinal axis of the belt 20 is substantially horizontal, the accessory 10 will be attached or coupled to the belt 20 in a substantially vertical orientation.

If it is desired to attach the accessory 10 to the belt 20 in a substantially horizontal orientation, the belt 20 is aligned with a vertical tunnel aperture (either the upper or first vertical tunnel aperture 121 or the lower or second vertical tunnel aperture 122), urged through the aligned vertical tunnel aperture, and woven or threaded through the vertical tunnel 123 until the belt 20 exits the opposite article tunnel aperture (either the lower or second vertical tunnel aperture 122 or the upper or first vertical tunnel aperture 121). If the belt 20 is positioned such that a longitudinal axis of the belt 20 is substantially horizontal, the accessory 10 will be attached or coupled to the belt 20 in a substantially horizontal orientation.

It should be understood that these orientations are relative to the orientation of the accessory 10 in relation to the belt 20.

In certain exemplary embodiments, as illustrated most clearly in FIGS. 17-22, one or more alternate attachment elements 130 may optionally be formed in or through the attachment interface panel 110. In various exemplary embodiments, the alternate attachment elements 130 are generally formed as slots or apertures through the attachment interface panel 110. Each attachment slot 132 is defined by one or more continuous edges.

The one or more alternate attachment elements 130 may optionally comprise a plurality of spaced apart attachment slots 132, arranged in a series or sequence of equally spaced rows and equally spaced columns.

In various exemplary embodiments, the size of each attachment slot 132 is influenced or dictated by the width of the accessory attachment element(s). For example, if an accessory attachment element has a width of approximately 1 inch, the width of the attachment slots 132 may optionally be slightly greater than approximately 1 inch, so as to allow the accessory attachment element(s) to be appropriately positioned through the attachment slots 132. It should be appreciated that the size and shape of each of the attachment slots 132 is a design choice based upon the desired functionality and/or appearance of the attachment interface panel 110 and the ability of each attachment slot 132 to allow at least a portion of an accessory attachment element to pass therethrough without undue or excess movement or play within each attachment slot 132.

The attachment slots 132 are arranged in a repeating or semi-repeating series or sequence of spaced apart, repeating patterns. In various exemplary embodiments, the attachment slots 132 are arranged in a column. The longitudinal axis of the column is parallel to the longitudinal axis of each accessory attachment element.

It should be appreciated that two or more adjacent attachment slots 132 may comprise a row and two or more adjacent attachment slots 132 may comprise a column. Thus, it should be appreciated that the number of attachment slots 132 formed in the attachment interface panel 110 is a design choice based upon the desired size and/or functionality of the attachment interface panel 110.

By arranging the attachment slots 132 in a repeating or semi-repeating series or sequence, tunnel segments are created between adjacent attachment slots 132 (typically along a longitudinal axis of a column).

The attachment interface panel 110 of the present disclosure is operable with as few as two attachment slots 132. Thus, the size and shape of the attachment interface panel 110 is a design choice, based upon, for example, the size and shape of the portion of attachment interface panel 110 that is desired to potentially accept attachment or coupling of accessory attachment element(s).

The attachment interface panel 110 is illustrated as comprising a somewhat rectangular portion of material that is at least partially attached or coupled the accessory 10 (or the carrier portion 18). As illustrated, the attachment interface panel 110 is attached or coupled to a portion of the accessory 10 (or the carrier portion 18) by attachment interface panel 110 attachment components 140, such as stitching proximate a perimeter of the attachment interface panel 110 and a perimeter of the accessory 10 (or the carrier portion 18).

In addition to the variability of size and shape of the attachment interface panel 110, the orientation of the attachment interface panel 110, relative to the accessory 10 (or the carrier portion 18), is also a design choice. Thus, while the attachment interface panel 110 is illustrated as being attached or coupled to the accessory 10 (or the carrier portion 18), such that the columns of attachment slots 132 are substantially parallel to the longitudinal axis, along the length, of the accessory 10 (or the carrier portion 18), it should be appreciated that this is merely exemplary and the attachment interface panel 110 may be attached at any desired angular or rotational orientation relative to an accessory 10 (or the carrier portion 18).

The portions of material of the attachment interface panel 110 between adjacent attachment slots 132 form tunnel segments. If the attachment interface panel 110 is attached to an accessory 10 (or the carrier portion 18), the tunnel segments are formed between the attachment interface panel 110 and the surface of the accessory 10 (or the carrier portion 18). The tunnel segments provide areas for securing the accessory attachment element to the attachment interface panel 110. In this manner, an accessory attachment element may be interwoven between the aligned tunnel segments to removably attach the accessory to the attachment interface panel 110.

In various exemplary embodiments, the attachment interface panel 110 comprises a stand-alone element, such as, for example, a sheet of attachment interface panel 110 material, which is attached or coupled within the accessory 10 (or the carrier portion 18). However, in various exemplary embodiments, the attachment slots 132, are formed as an integral component of the accessory 10 (or the carrier portion 18).

Figure 21:
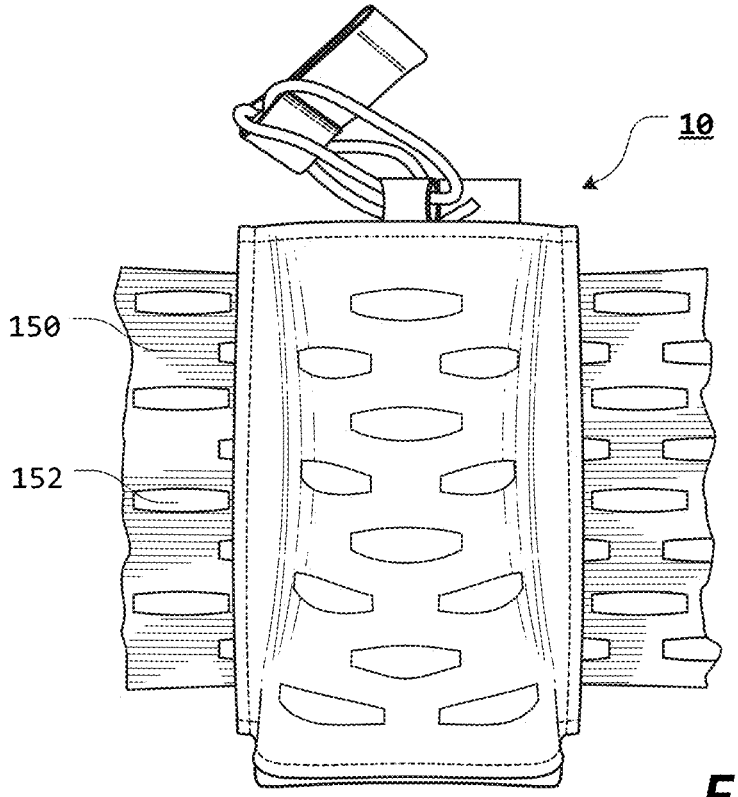
FIG. 21 illustrates a front perspective view of an accessory having a bi-directional accessory attachment interface, attached to an exemplary MOLLE or MOLLE-type portion of material in a substantially vertical orientation, according to an exemplary embodiment of the present disclosure.
Figure 22:
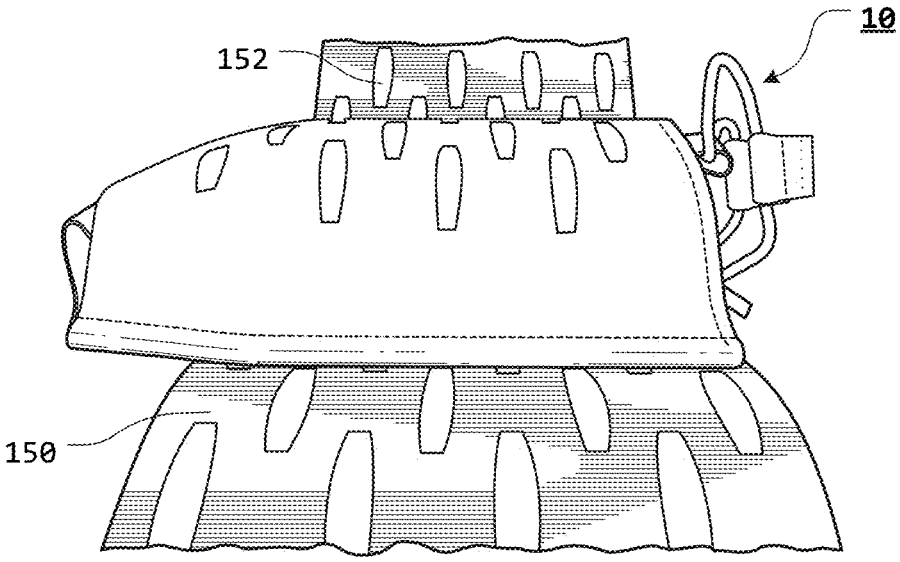
FIG. 22 illustrates a side perspective view of an accessory having a bi-directional accessory attachment interface, attached to an exemplary MOLLE or MOLLE-type portion of material in a substantially vertical orientation, according to an exemplary embodiment of the present disclosure.

As illustrated most clearly in FIGS. 21-22, the accessory 10 may be attached or coupled to an exemplary MOLLE or MOLLE-type portion of material 150, via interaction of attachment slots 132 of the attachment interface panel 110 and one or more MOLLE or MOLLE-type apertures 152 with one or more accessory attachment elements (not shown).

When the accessory 10 is placed adjacent the MOLLE or MOLLE-type portion of material 150 such that the attachment slots 132 are within the spaces between the spaced apart MOLLE or MOLLE-type apertures 152 (and the MOLLE or MOLLE-type apertures 152 are within the spaces between the spaced apart attachment slots 132) and corresponding tunnel segments and accessory tunnel segments are aligned, an accessory attachment element (not shown) may be interwoven between the aligned tunnel segments and accessory tunnel segments (alternating between horizontal carrier webbing element portions on the host or attachment interface panel 110 and horizontal webbing portions on the MOLLE or MOLLE-type portion of material 150) to removably attach the accessory 10 to the MOLLE or MOLLE-type portion of material 150.

Thus, through the use of certain exemplary embodiments of the accessory attachment interface 100, an accessory 10 may be mounted to a MOLLE or MOLLE-type portion of material 150. Likewise, if a particular attachment interface panel 110 includes one or more alternate attachment elements 130, a variety of accessories may be interchangeably mounted to a MOLLE or MOLLE-type portion of material 150 to accommodate a variety of desired configurations.

It should be appreciated that the terms "MOLLE-type" or "MOLLE" system are not used to describe a specific system, but to generically describe accessory attachment systems that utilize interwoven PALS (Pouch Attachment Ladder System) webbing for modular accessory attachment portions.

It is believed that the level of description provided herein for interweaving the accessory attachment element between the attachment slots 132 and the MOLLE or MOLLE-type apertures 152 is sufficient to enable one of ordinary skill in the art to understand and practice the systems, methods, and apparatuses, as described.

While the present disclosure has been described in conjunction with the exemplary embodiments outlined above, the foregoing description of exemplary embodiments of the present disclosure, as set forth above, are intended to be illustrative, not limiting and the fundamental disclosed systems, methods, and/or apparatuses should not be considered to be necessarily so constrained. It is evident that the present disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the present disclosure. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the present disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the present disclosure, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the present disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A bi-directional accessory attachment interface, comprising:

an attachment interface panel extending between an upper edge, a lower edge, a first edge, and a second edge, wherein said attachment interface panel includes one or more alternate attachment elements, wherein said attachment interface panel is attached or coupled, at one or more attachment points/areas to an accessory to define a first vertical tunnel aperture between a portion of said upper edge of said attachment interface panel and said accessory, to define a second vertical tunnel aperture between a portion of said lower edge of said attachment interface panel and said accessory, to define a first horizontal tunnel aperture between a portion of said first edge of said attachment interface panel and said accessory, and to define a second horizontal tunnel aperture between a portion of said second edge of said attachment interface panel and said accessory, wherein a vertical tunnel is formed between said first vertical tunnel aperture and said second vertical tunnel aperture, wherein a horizontal tunnel is formed between said first horizontal tunnel aperture and said second horizontal tunnel aperture, and wherein a first horizontal tunnel notch is formed in said attachment interface panel to further define said first horizontal tunnel aperture and a second horizontal tunnel notch is formed in said attachment interface panel to further define said second horizontal tunnel aperture.

2. The bi-directional accessory attachment interface of claim 1, wherein said attachment interface panel is attached or coupled at one or more attachment points/areas, to a portion of a carrier material of said accessory.

3. The bi-directional accessory attachment interface of claim 1, wherein at least a portion of said horizontal tunnel is formed between a rear surface of said attachment interface panel and an outer surface of said accessory.

4. The bi-directional accessory attachment interface of claim 1, wherein at least a portion of said vertical tunnel is formed between a rear surface of said attachment interface panel and an outer surface of said accessory.

5. The bi-directional accessory attachment interface of claim 1, wherein a longitudinal axis of said horizontal tunnel and a longitudinal axis of said vertical tunnel are offset by approximately 90°.

6. The bi-directional accessory attachment interface of claim 1, wherein a longitudinal axis of said horizontal tunnel and a longitudinal axis of said vertical tunnel are offset by an obtuse angle.

7. The bi-directional accessory attachment interface of claim 1, wherein a longitudinal axis of said horizontal tunnel and a longitudinal axis of said vertical tunnel are offset by an acute angle.

8. The bi-directional accessory attachment interface of claim 1, wherein said first vertical tunnel aperture is separated from said second vertical tunnel aperture by a distance that is equal to or less than a length of said attachment interface panel.

9. The bi-directional accessory attachment interface of claim 1, wherein a first vertical tunnel notch is formed in said attachment interface panel to further define said first vertical tunnel aperture and a second vertical tunnel notch is formed in said attachment interface panel to further define said second vertical tunnel aperture.

10. The bi-directional accessory attachment interface of claim 1, wherein a portion of said horizontal tunnel is formed between a rear surface of said attachment interface panel and an outer surface of said accessory.

11. The bi-directional accessory attachment interface of claim 1, wherein said one or more alternate attachment elements are formed in or through said attachment interface panel.

12. The bi-directional accessory attachment interface of claim 11, wherein said one or more alternate attachment elements comprise a plurality of spaced apart matrix apertures, wherein said matrix apertures are arranged in a series or sequence of equally spaced rows and equally spaced columns.

13. A bi-directional accessory attachment interface of an accessory, comprising:

an attachment interface panel extending between an upper edge, a lower edge, a first edge, and a second edge, said attachment interface panel including one or more alternate attachment elements, said attachment interface panel having a first vertical tunnel aperture formed between a portion of said upper edge of said attachment interface panel and said accessory, having a second vertical tunnel aperture formed between a portion of said lower edge of said attachment interface panel and said accessory, having a first horizontal tunnel aperture formed between a portion of said first edge of said attachment interface panel and said accessory, and having a second horizontal tunnel aperture formed between a portion of said second edge of said attachment interface panel and said accessory, wherein a vertical tunnel is formed between said first vertical tunnel aperture and said second vertical tunnel aperture, wherein a horizontal tunnel is formed between said first horizontal tunnel aperture and said second horizontal tunnel aperture, and wherein a first horizontal tunnel notch is formed in said attachment interface panel to further define said first horizontal tunnel aperture and a second horizontal tunnel notch is formed in said attachment interface panel to further define said second horizontal tunnel aperture.

14. The bi-directional accessory attachment interface of claim 13, wherein a first vertical tunnel notch is formed in said attachment interface panel to further define said first vertical tunnel aperture, a second vertical tunnel notch is formed in said attachment interface panel to further define said second vertical tunnel aperture.

15. The bi-directional accessory attachment interface of claim 13, wherein said one or more alternate attachment elements are formed in or through said attachment interface panel.

16. The bi-directional accessory attachment interface of claim 15, wherein said one or more alternate attachment elements comprise a plurality of spaced apart matrix apertures, wherein said matrix apertures are arranged in a series or sequence of equally spaced rows and equally spaced columns.

17. A bi-directional accessory attachment interface, comprising:

an attachment interface panel extending between an upper edge, a lower edge, a first edge, and a second edge, wherein said attachment interface panel includes one or more alternate attachment elements, wherein said attachment interface panel is attached or coupled to an accessory at one or more attachment points/areas, wherein a first vertical tunnel aperture is defined between a portion of said upper edge of said attachment interface panel and said accessory, between at least two of said at least one or more attachment points/areas, wherein a second vertical tunnel aperture is defined between a portion of said lower edge of said attachment interface panel and said accessory, between at least two of said at least one or more attachment points/areas, wherein a first horizontal tunnel aperture is defined between a portion of said first edge of said attachment interface panel and said accessory, between at least two of said at least one or more attachment points/areas, and wherein a second horizontal tunnel aperture is defined between a portion of said second edge of said attachment interface panel and said accessory, between at least two of said at least one or more attachment points/areas, wherein a vertical tunnel is formed between said first vertical tunnel aperture and said second vertical tunnel aperture, wherein a horizontal tunnel is formed between said first horizontal tunnel aperture and said second horizontal tunnel aperture, and wherein a first vertical tunnel notch is formed in said attachment interface panel to further define said first vertical tunnel aperture, a second vertical tunnel notch is formed in said attachment interface panel to further define said second vertical tunnel aperture, a first horizontal tunnel notch is formed in said attachment interface panel to further define said first horizontal tunnel aperture, and a second horizontal tunnel notch is formed in said attachment interface panel to further define said second horizontal tunnel aperture.

18. The bi-directional accessory attachment interface of claim 17, wherein said one or more alternate attachment elements comprise a plurality of spaced apart matrix apertures, wherein said matrix apertures are arranged in a series or sequence of equally spaced rows and equally spaced columns.

19. The bi-directional accessory attachment interface of claim 17, wherein at least a portion of said horizontal tunnel is formed between a rear surface of said attachment interface panel and an outer surface of said accessory.

20. The bi-directional accessory attachment interface of claim 17, wherein at least a portion of said vertical tunnel is formed between a rear surface of said attachment interface panel and an outer surface of said accessory.

* * * * *